US008232928B2

(12) United States Patent
Johansen et al.

(10) Patent No.: US 8,232,928 B2
(45) Date of Patent: Jul. 31, 2012

(54) DUAL-POLARIZED ANTENNA ARRAY

(75) Inventors: Brian W. Johansen, McKinney, TX (US); James M. Irion, II, Allen, TX (US); Darrell W. Miller, Allen, TX (US)

(73) Assignee: Raytheon Company, Waltham, MA (US)

( * ) Notice: Subject to any disclaimer, the term of this patent is extended or adjusted under 35 U.S.C. 154(b) by 582 days.

(21) Appl. No.: 12/489,130

(22) Filed: Jun. 22, 2009

(65) Prior Publication Data

US 2009/0315802 A1 Dec. 24, 2009

Related U.S. Application Data

(60) Provisional application No. 61/132,872, filed on Jun. 23, 2008, provisional application No. 61/132,849, filed on Jun. 23, 2008.

(51) Int. Cl.
*H01Q 21/00* (2006.01)

(52) U.S. Cl. ..... 343/853; 343/893

(58) Field of Classification Search ..... 343/853, 343/767, 770, 893
See application file for complete search history.

(56) References Cited

U.S. PATENT DOCUMENTS

| | | | | |
|---|---|---|---|---|
| 4,123,730 | A | 10/1978 | Fikart | |
| 4,173,019 | A | 10/1979 | Williams | |
| 4,903,340 | A | 2/1990 | Sorensen | |
| 6,850,203 | B1 | 2/2005 | Schuneman et al. | |
| 6,867,742 | B1 | 3/2005 | Irion, II et al. | |
| 7,138,952 | B2 | 11/2006 | McGrath et al. | |
| 7,264,479 | B1 | 9/2007 | Lee | |
| 7,274,328 | B2 | 9/2007 | McIntire et al. | |
| 7,354,315 | B2 | 4/2008 | Goetz et al. | |
| 7,500,882 | B2 | 3/2009 | Goetz et al. | |
| 2004/0080455 | A1 | 4/2004 | Lee | |
| 2005/0007286 | A1* | 1/2005 | Trott et al. | 343/770 |
| 2006/0038732 | A1 | 2/2006 | DeLuca et al. | |
| 2007/0018762 | A1 | 1/2007 | Wheeler et al. | |
| 2009/0073075 | A1* | 3/2009 | Irion et al. | 343/859 |
| 2011/0057852 | A1* | 3/2011 | Holland et al. | 343/795 |
| 2011/0148725 | A1* | 6/2011 | Cavener et al. | 343/770 |

OTHER PUBLICATIONS

PCT Notification of Transmittal of the International Search Report and the Written Opinion of the International Searching Authority, or the Declaration, International Application No. PCT/US2009/048206, dated Oct. 12, 2009, 12 pages.

PCT Notification of Transmittal of the International Search Report and the Written Opinion of the International Searching Authority, or the Declaration, International Application No. PCT/US2009/048207, dated Oct. 21, 2009, 11 pages.

* cited by examiner

*Primary Examiner* — Hoanganh Le
(74) *Attorney, Agent, or Firm* — Christie, Parker & Hale, LLP

(57) ABSTRACT

According to one embodiment, an antenna array includes a plurality of first antenna elements having a first polarity and a plurality of second antenna elements having a second polarity. A feed circuit couples the plurality of first antenna elements and the plurality of second antenna elements to an antenna drive circuit. The feed circuit is configured on a plurality of columns extending in a direction that is oblique to the plurality of first antenna elements and the plurality of second antenna elements.

28 Claims, 12 Drawing Sheets

DUAL-POLARIZED ANTENNA ARRAY

RELATED APPLICATIONS

Pursuant to 35 U.S.C. §119(e), this application claims priority to U.S. Provisional Patent Application Ser. No. 61/132,872, entitled MAGNETIC INTERCONNECTION DEVICE, filed Jun. 23, 2008. U.S. Provisional Patent Application Ser. No. 61/132,872 is hereby incorporated by reference.

Pursuant to 35 U.S.C. §119(e), this application claims priority to U.S. Provisional Patent Application Ser. No. 61/132,849, entitled DUAL-POLARIZED ANTENNA ARRAY, filed Jun. 23, 2008. U.S. Provisional Patent Application Ser. No. 61/132,849 is hereby incorporated by reference.

TECHNICAL FIELD OF THE DISCLOSURE

This disclosure generally relates to antennas, and more particularly, to a dual-polarized antenna array having a feed circuit that is configured in an oblique orientation relative to the antenna elements.

BACKGROUND OF THE DISCLOSURE

Microwave communications includes transmission and receipt of electromagnetic energy that extends from the short wave frequencies to the near infrared frequencies. In order to utilize electromagnetic energy at these frequencies, a plurality of differing types of antennas have been developed. Due to the relatively strong polarization characteristics of electromagnetic energy at these frequencies, antenna arrays have been developed that are capable of controlling the beam polarization of the electromagnetic wave.

SUMMARY OF THE DISCLOSURE

According to one embodiment, an antenna array includes a plurality of first antenna elements having a first polarity and a plurality of second antenna elements having a second polarity. A feed circuit couples the plurality of first antenna elements and the plurality of second antenna elements to an antenna drive circuit. The feed circuit is configured on a plurality of columns extending in a direction that is oblique to the plurality of first antenna elements and the plurality of second antenna elements.

Some embodiments of the present disclosure may provide numerous technical advantages. A technical advantage of one embodiment may include the ability to eliminate the need for any non-planar interconnects between the antenna elements and the antenna drive circuit. Another technical advantage of one embodiment may include the ability to provide a feed circuit that is configured at oblique angles relative to antenna elements. Teachings of certain embodiments recognize that providing a feed circuit at an oblique angle may reduce parasitic effects caused by bending antenna feed circuits. Teachings of certain embodiments may also recognize the capability to lower construction costs and mass-produce antenna components.

Although specific advantages have been disclosed hereinabove, it will be understood that various embodiments may include all, some, or none of the disclosed advantages. Additionally, other technical advantages not specifically cited may become apparent to one of ordinary skill in the art following review of the ensuing drawings and their associated detailed description.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS

It should be understood at the outset that, although example implementations of embodiments of the invention are illustrated below, the present invention may be implemented using any number of techniques, whether currently known or not. The present invention should in no way be limited to the example implementations, drawings, and techniques illustrated below. Additionally, the drawings are not necessarily drawn to scale.

Antenna arrays, such as active electronically scanned arrays (AESAs), may be useful for transmission and reception of microwave signals at a desired polarity, scan pattern, and/or look angle. Active electronically scanned arrays may be driven by an electrical drive circuit that generates electrical signals for transmission by the active electronically scanned array or conditions electrical signals received by the active electronically scanned array. Coupling of orthogonal antenna elements to its antenna drive circuit, however, may be difficult to accomplish due to the various antenna elements that may be configured orthogonally relative to one another.

Figure 1A:
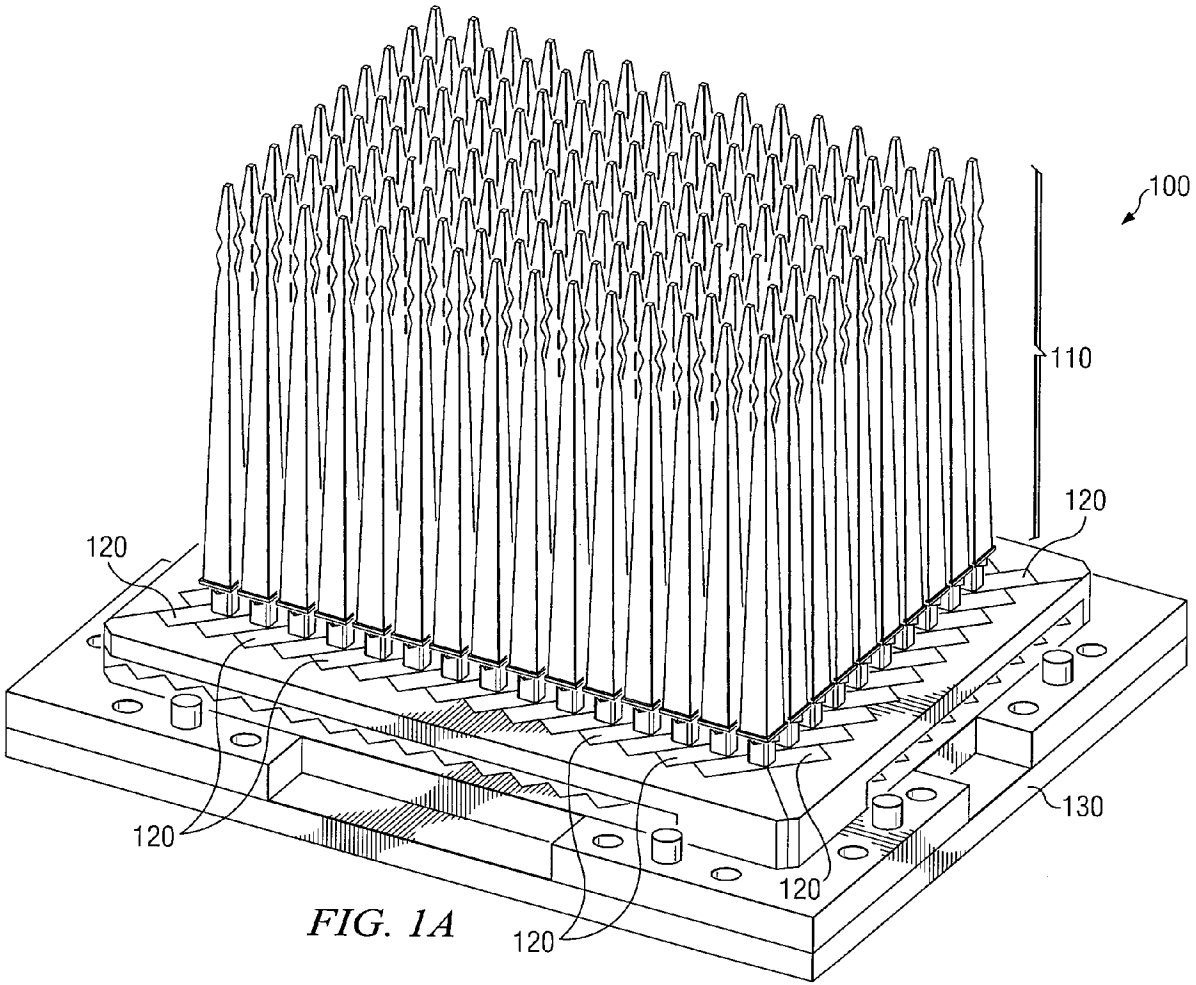
FIGS. 1A-1E show an antenna array according to one embodiment.

FIG. 1A shows an antenna array 100 according to one embodiment. Antenna array 100 features tapers 110, a columns 120, and an array base 130. Each of the tapers 110 connects to a column 120, which then connects to the array base 130. In some embodiments, an individual column 120 may support more than one taper 110.

Tapers 110 may be formed into any suitable shape. According to one non-limiting example of one embodiment, tapers 110 may be conical. In another non-limiting example, tapers 110 may be shaped according to a higher-order polynomial.

Columns 120 may be formed from any suitable material. For example, in one embodiment, columns 120 may be made from metal or a metal alloy. Additionally, array base 130 may be formed from any suitable material. For example, in one embodiment, array base 130 may be made from metal or a metal alloy.

Figure 1B:
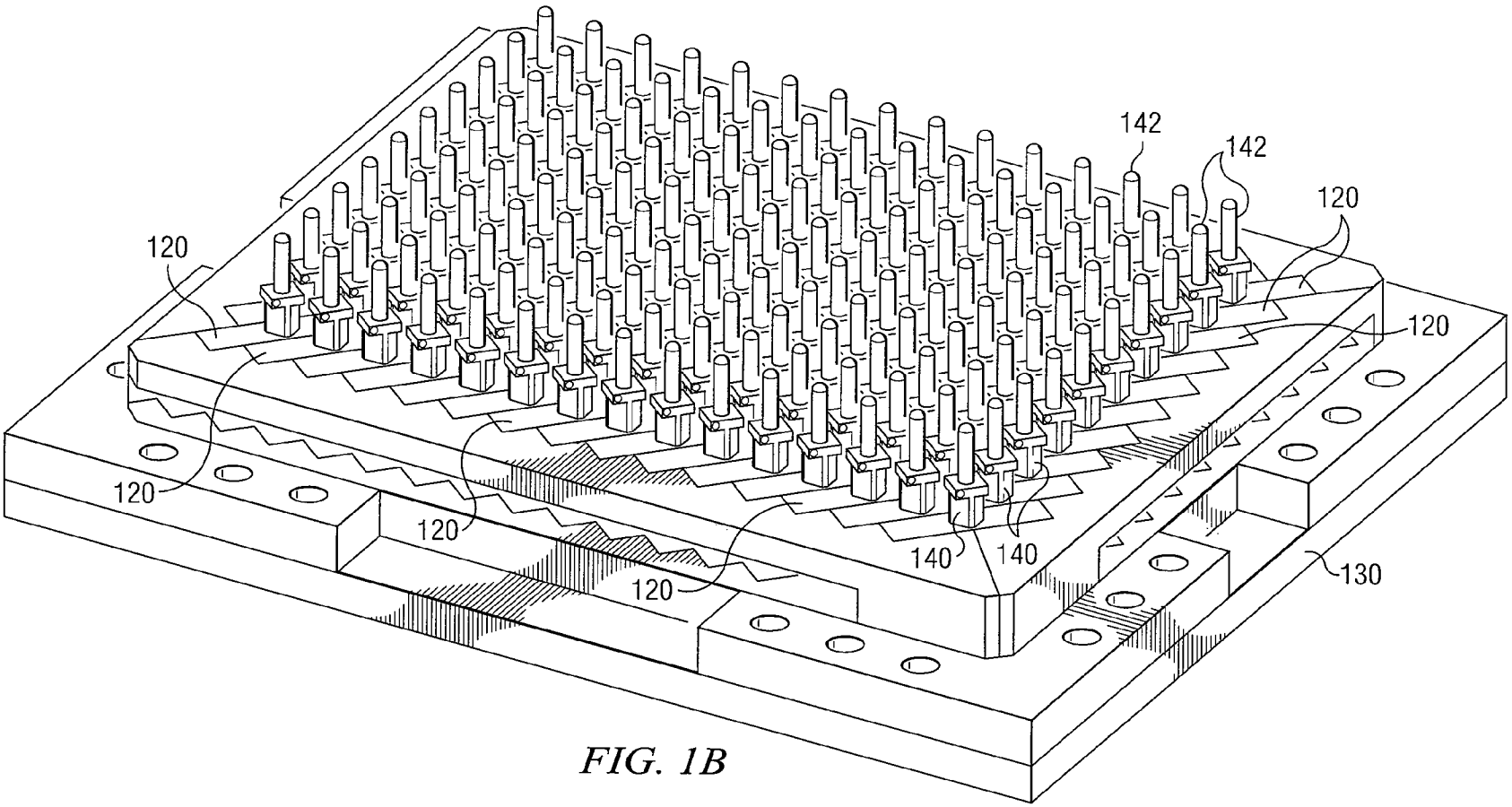

FIG. 1B shows the antenna array 100 of FIG. 1A with the tapers 110 removed. Removing the tapers 110 reveals posts 140 secured to the columns 120. In some embodiments, the number of posts 140 may correspond to the number of tapers 110 such that one taper 110 connects to one post 140.

In some embodiments, these posts 140 may feature openings 146 (shown in FIGS. 1C-1E) capable of receiving element alignment pins 142, the element alignment pins 142 securing the tapers 110 to the posts 140. This example mechanisms for securing the tapers 110 to the posts 140 will be described in greater detail with respect to FIG. 1E. However, other embodiments may incorporate any suitable attachment mechanism.

Figure 1C:
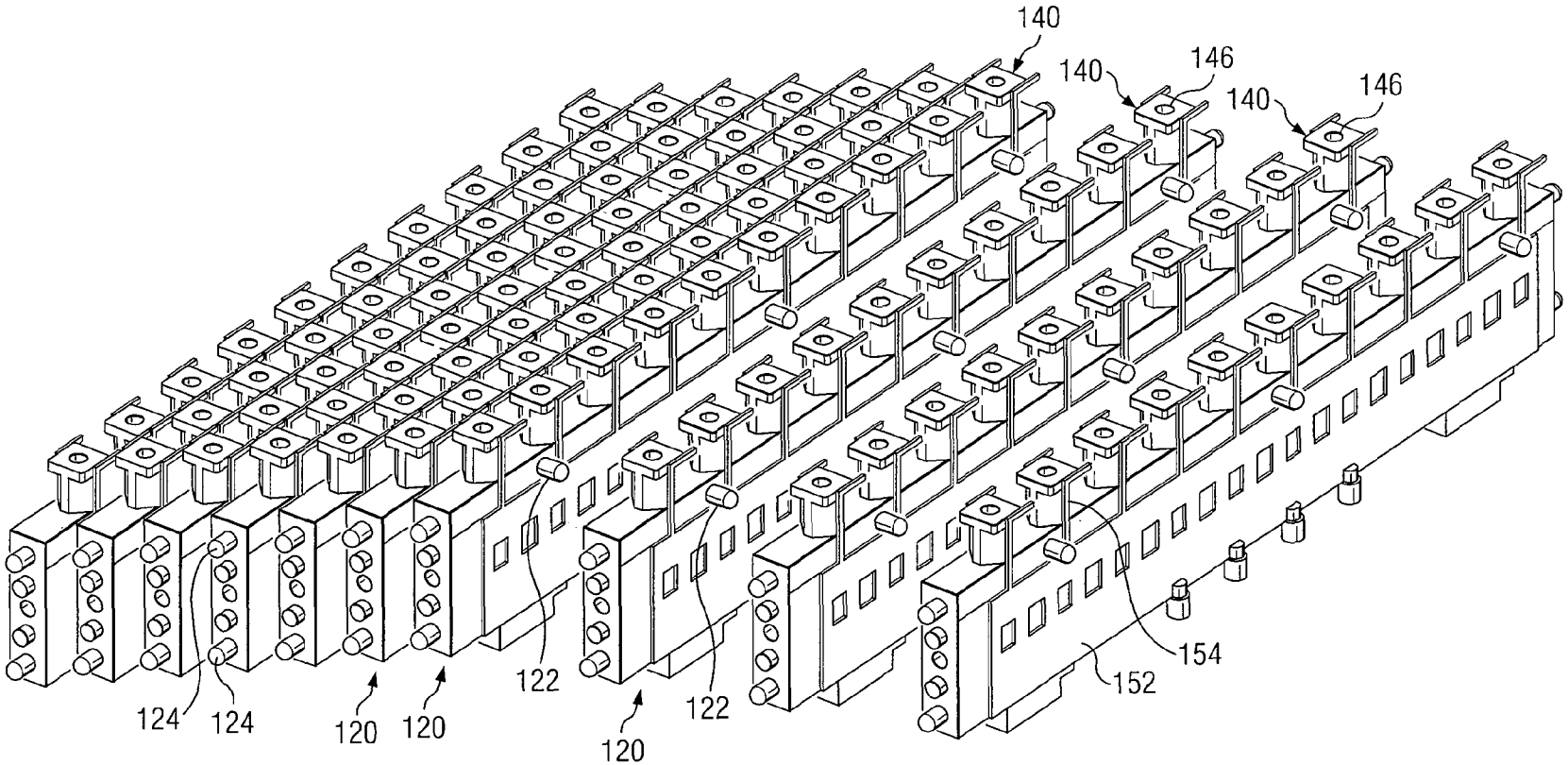

FIG. 1C shows the columns 120 of FIG. 1B according to one embodiment. The columns 120 of FIG. 1C feature radiator alignment pins 122, column alignment pins 124, posts 140, openings 146, a feed circuit 152, and connectors 154. The radiator alignment pins 122 align adjacent columns. For example, in some embodiments, radiator alignment pins 122 may align adjacent columns such that the posts 140 form a checkerboard pattern. The column alignment pins 124 align the columns 120 to the array base 130. Embodiments of the feed circuit 152 and the connectors 154 will be described in further detail with respect to FIGS. 2A and 2B.

Figure 1D:
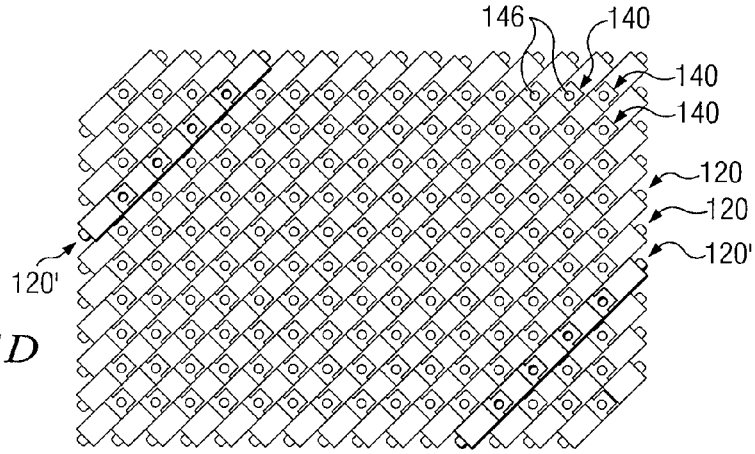

FIG. 1D shows a top plan view of the columns 120 of FIG. 1B according to one embodiment. FIG. 1D shows columns 120 of varying lengths. For example, column 120' features four posts 140. Other embodiments of the columns 120 may feature more or fewer posts 140. For example, FIG. 1D shows columns 120 with a number of posts ranging from 1 through 10, although embodiments are not limited to this range. FIG. 1D further shows that columns 120 may be aligned such that they collectively form an approximately square or rectangular structure. However, embodiments are not limited to such an arrangement, and columns 120 of varying lengths may be arranged to form any shape structure.

Figure 1E:
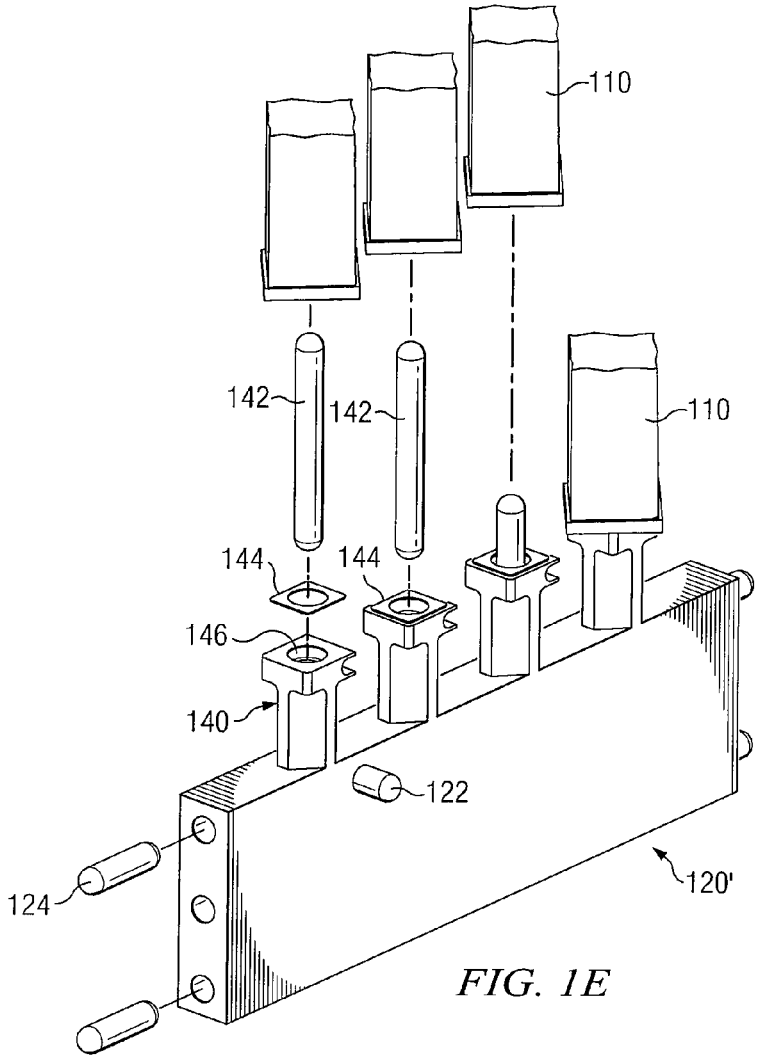

FIG. 1E shows the four post column 120' of FIG. 1D. Column 120' features radiator alignment pins 122, column alignment pins 124, posts 140, element alignment pins 142, gaskets 144, and openings 146. In some embodiments, the gaskets 144 may be placed along the top of a post 140. For example, in some embodiments, the gaskets 144 separate the tapers 110 from the posts 140. Teachings of certain embodiments recognize that the gaskets 144 may provide vibration support for the tapers 110. In some embodiments, the gaskets 144 may be made from any conductive material, such as solder, epoxy, or other conductive gasket. Teachings of certain embodiments recognize that the gaskets 144 may improve the conductive and mechanical bond between the tapers 110 and the posts 140.

Figure 2B:
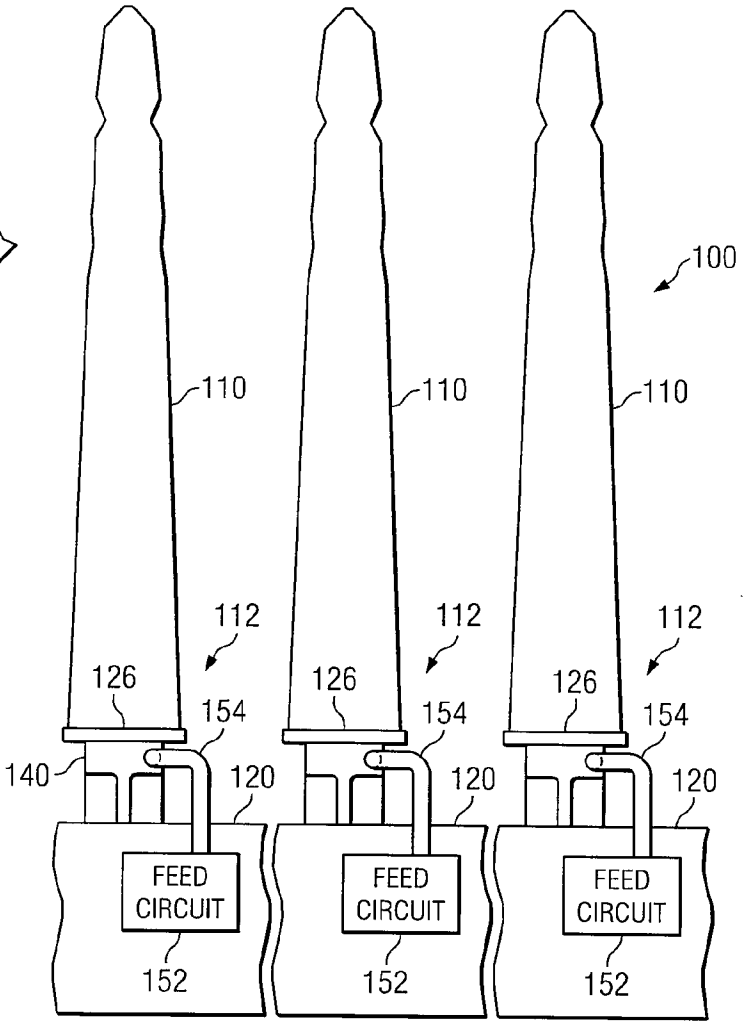
FIGS. 2A and 2B show plan and crossection views of the antenna array of FIGS. 1A-1E.
Figure 2A:
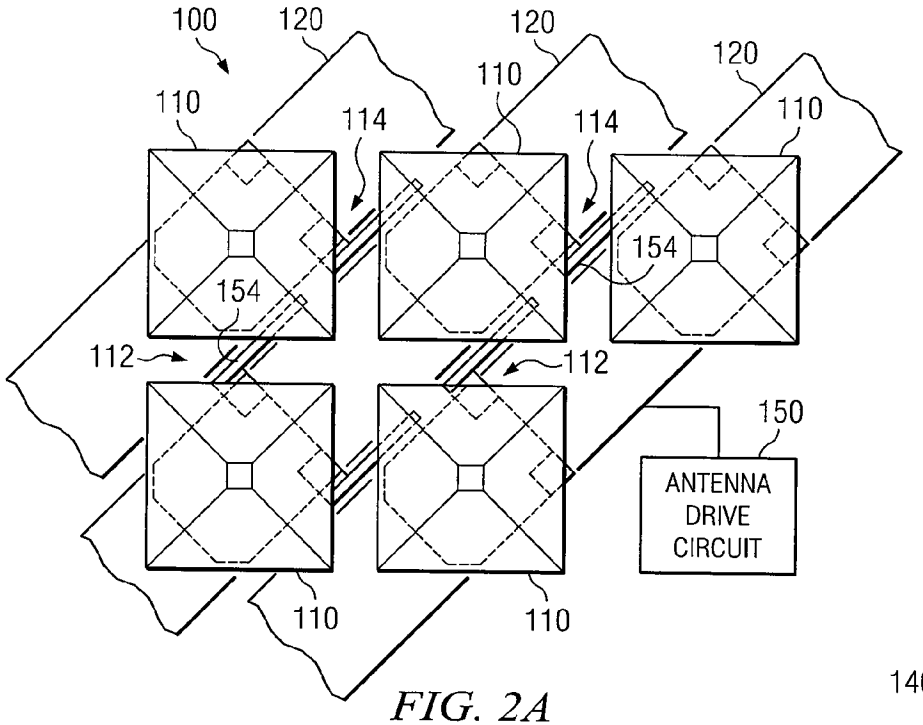

FIGS. 2A and 2B show the antenna array 100 of FIG. 1A according to one embodiment. Antenna array 100 includes a number of first antenna elements 112 and a number of second antenna elements 114 that are formed between adjacent tapers 110. For example, in some embodiments, each taper 110 may have four sides that form two first antenna elements 112 and two second antenna elements 114 with adjacent tapers 110.

The first and second antenna elements 112 and 114 may be coupled to an antenna drive circuit 150 through a feed circuit 152. Feed circuit 152 is configured on a number of columns 120 that extend in a direction that is oblique to first antenna elements 112 and second antenna elements 114. Teachings of certain embodiments recognize that feed circuit 152 may not require significant bending of conducting paths to drive either first antenna elements 112 or second antenna elements 114. In one embodiment, column 120 extends in a direction that is approximately 45 degrees relative to first antenna elements 112 and second antenna elements 114. In this manner, first antenna elements 112 and second antenna elements 114 may be fed equally by feed circuit 152.

First antenna elements 112 and second antenna elements 114 may be any type of element that transmits and/or receives electromagnetic radiation. In the particular embodiment shown, first antenna elements 112 and second antenna elements 114 are slotline radiators that are formed from a number of conductive tapers 110 having a square cross-sectional shape at a base 126. In some embodiments, the shape and/or size of the base 126 may correspond to the shape of the corresponding post 140. However, embodiments are not limited to a square cross-sectional shape, but instead may have cross-sections of any shape or size.

Feed circuit 152 may be configured on a number of columns 120 that provide structural support for itself and the tapers 110. In one embodiment, feed circuit 152 is in communication with connectors 154. Embodiments of the connectors 154 may include both independent, separable connectors or connectors that are permanent extensions of the feed circuit 152. In one embodiment, the connectors 154 are transmission line conductors that extend across the bases of two adjacent tapers 110 to form a balun. The balun converts unbalanced signals from antenna drive circuit 150 to balanced signals that may be propagated through first antenna elements 112 and second antenna elements 114 as electro-magnetic energy. For example, in the illustrated embodiment, the posts 140 feature recessed edges below the top of the posts 140; in some embodiments, these recessed edges may form a balun slot between adjacent posts 140.

Each column 120 may be configured with a portion of feed circuit 152, which may be, for example, transmit/receive integrated microwave module (TRIMM) cards. In one example embodiment, the TRIMM cards may include ports that connect with the array base 130 when the columns 120 are secured within the array base 130. For example, securing the columns 120 within the array base 130 may establish a connection between the TRIMM cards and the antenna drive circuit 150.

Various embodiments may feature feed circuits 152 and connectors 154 configured according to several architectures. Two example embodiments are a double-sided feed architecture and a single-sided feed architecture. Double-sided feed circuit architecture generally refers to implementation of portions of feed circuit 152 on both sides of each column 120. Single-sided feed circuit architecture generally refers to implementation of a portion of feed circuit 152 on only one side of each column 120. An example of a double-sided feed circuit architecture is shown in FIGS. 3A-3C, and an example of a single-sided feed architecture circuit architecture is shown in FIGS. 4A-6B.

Figure 3A:
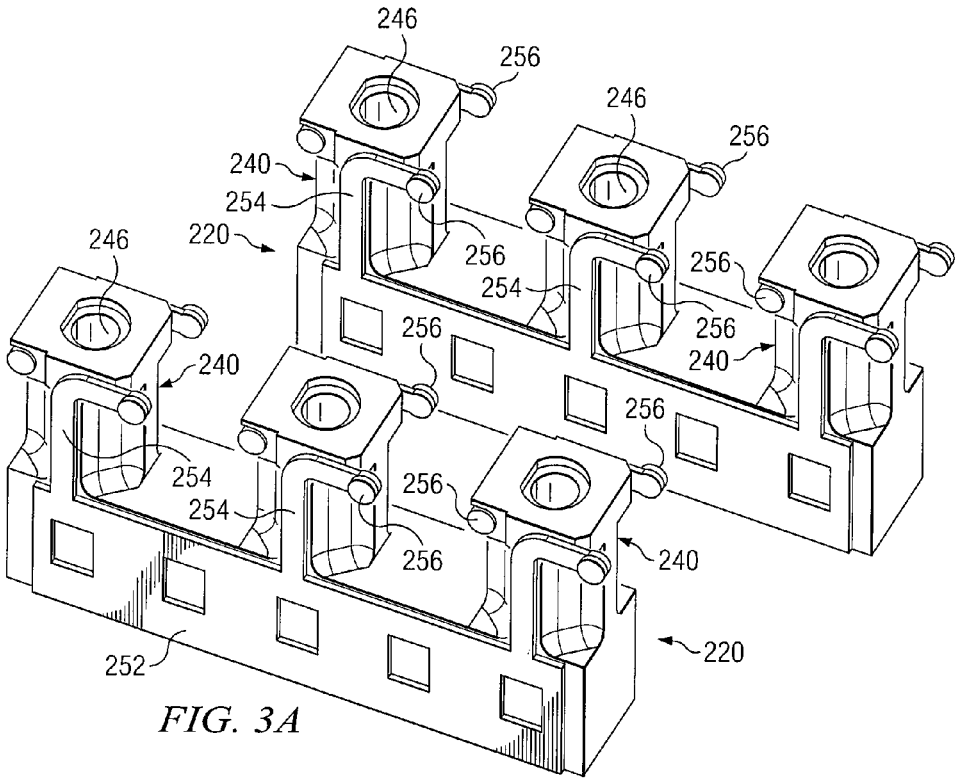
FIGS. 3A, 3B, and 3C show perspective views of a feed circuit implemented in a dual-sided feed architecture according to one embodiment.
Figure 3B:
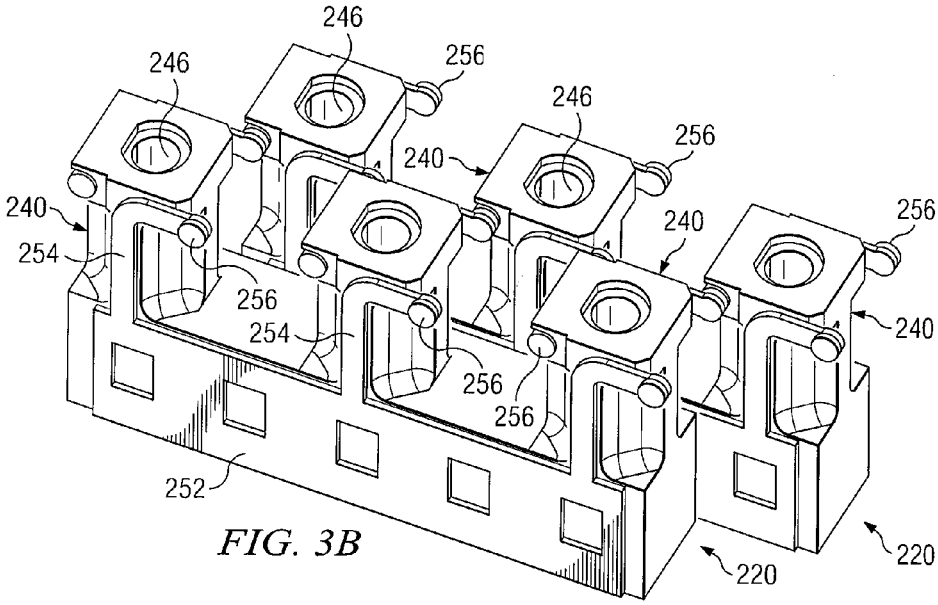
Figure 3C:
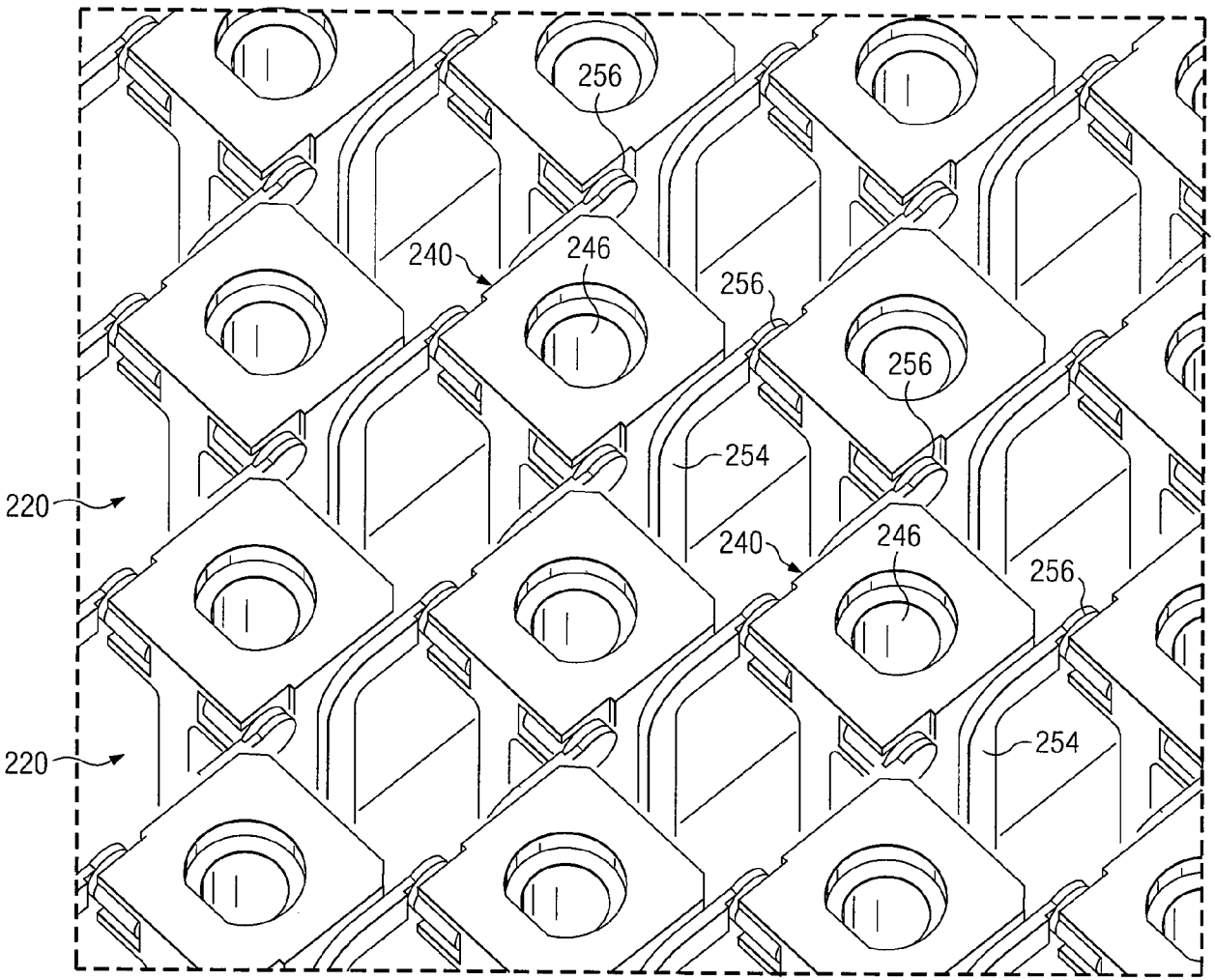

FIGS. 3A, 3B, and 3C show perspective views of feed circuit 252 implemented in a dual-sided feed architecture according to one embodiment. The dual-sided feed architecture features columns 220 with posts 240. The posts 240 feature openings 246 capable of receiving element alignment pins 242 (not shown), the element alignment pins 242 securing the tapers 210 (not shown) to the posts 240. Examples of the openings 246, the element alignment pins 242, and the tapers 210 may include the openings 146, the element alignment pins 142, and the tapers 110 of FIGS. 1A-1E and 2A-2B.

FIGS. 3A and 3B show perspective views of two columns 220 before and after placement together, respectively. FIG. 3C shows a perspective view of several columns 220 placed together as part of an array configuration.

In one embodiment, a portion of feed circuit 252 configured on a side of each column 220 may include connectors 254, such as transmission line conductors, to form baluns. In one embodiment, transmission line conductors 254 may be formed of flexible conductors, such as copper traces, that releasably couple energy from the antenna feed circuit 252 to the antenna balun structure configured across adjacent columns 320. In some embodiments, the connectors 254 may include both flexible conductors and rigid contacts for electrical connection to portions of feed circuit 252 configured on adjacent columns 220. For example, in one embodiment, transmission line conductors 254 may be paired such that one includes a flexible conductors and the other includes a rigid contact.

Electrical coupling of flexible conductors to portion of feed circuit 252 on other columns may be provided using any suitable approach. In one embodiment, flexible conductors may be configured with magnetic or ferromagnetic devices 256 that provide an attractive force to magnetic or ferromagnetic devices 256 configured on an adjacent column 220. For example, electrical interconnection may be accomplished by placing columns 220 adjacent to one another such that flexible conductors may be attracted using magnetic or ferromagnetic devices 256 to form an electrical connection to a portion of feed circuit 254 on another column 220. As a non-limiting example, magnetic or ferromagnetic devices 256 may be incorporated using the apparatus and method of U.S. application Ser. No. 12/489,015, entitled "Magnetic Interconnection Device," which is being filed concurrently.

Figure 4A:
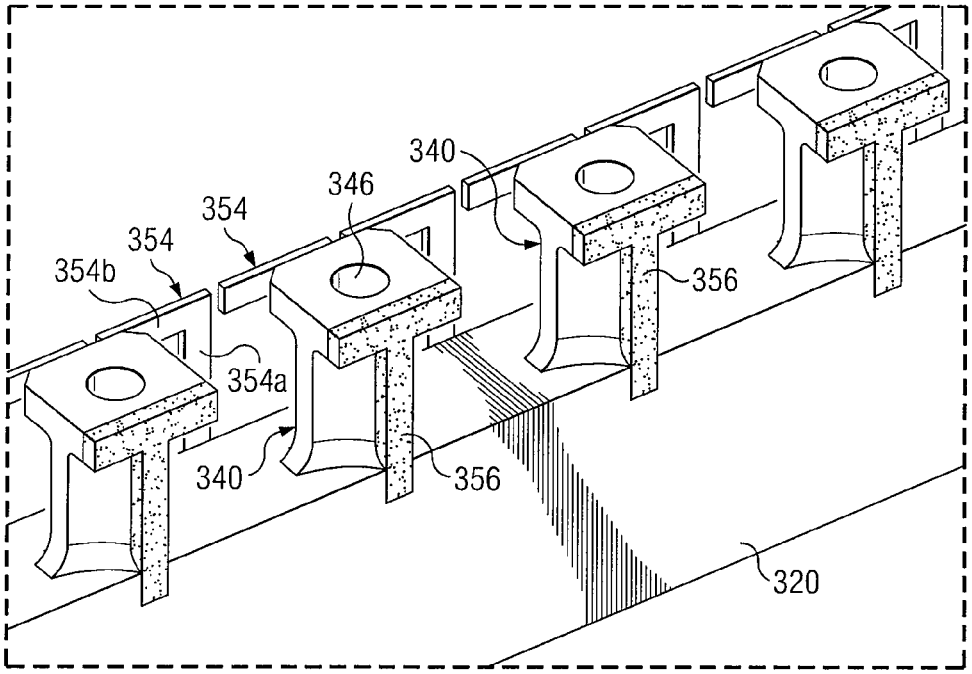
FIGS. 4A, 4B, and 4C show perspective views of a feed circuit implemented in a single-sided feed architecture according to one embodiment.
Figure 4B:
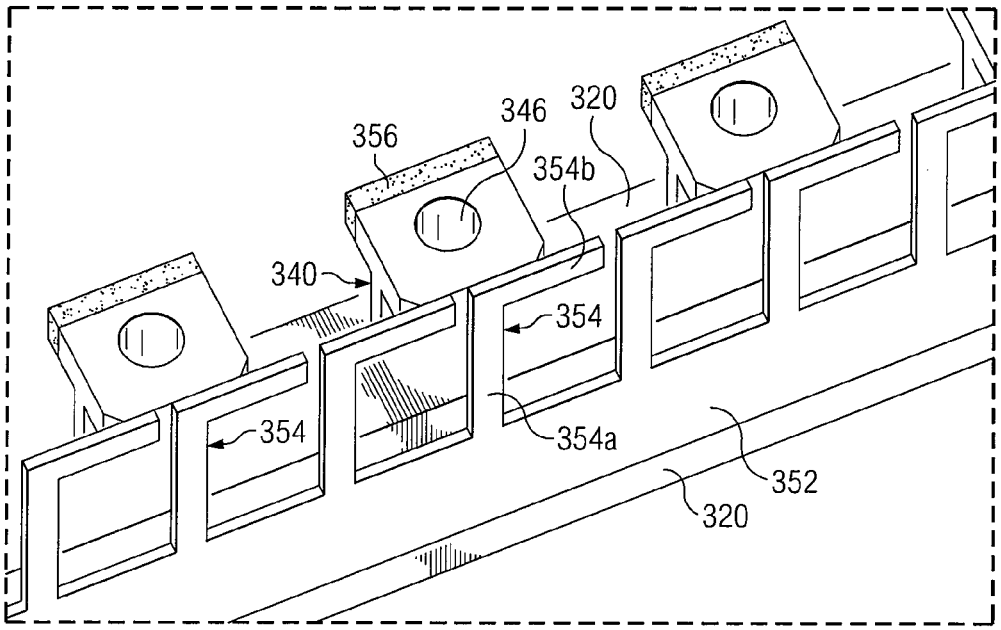
Figure 4C:
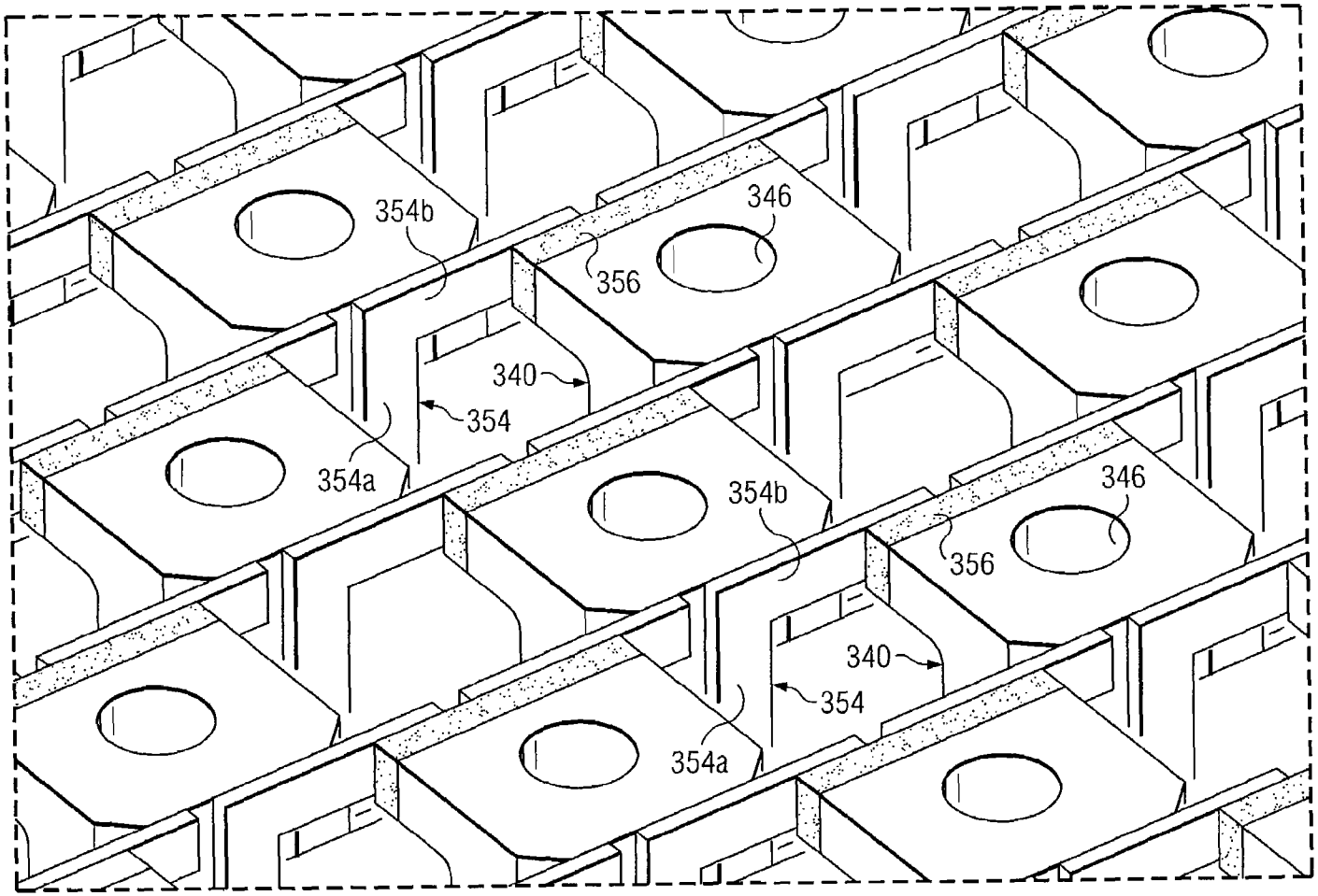

FIGS. 4A, 4B, and 4C show perspective views of feed circuit 352 implemented in a single-sided feed architecture according to one embodiment. The single-sided feed architecture features columns 320 with posts 340. The posts 340 feature openings 346 capable of receiving element alignment pins 342 (not shown), the element alignment pins 342 securing the tapers 310 (not shown) to the posts 340. Examples of the openings 346, the element alignment pins 342, and the tapers 310 may include the openings 346, the element alignment pins 342, and the tapers 310 of FIGS. 1A-1E and 2A-2B.

FIGS. 4A and 4B show perspective views of both sides of a column 320 configured in the single-sided feed circuit architecture. FIG. 4A shows a side of column 320 configured with a portion of feed circuit 352 while FIG. 4B shows a side of column 320 void of a portion of feed circuit 352. FIG. 4C shows a perspective view of several columns 320 placed together as part of an array configuration.

In this particular embodiment, the side of column 320 void of a portion of feed circuit 352 has magnetic or ferromagnetic devices 356 rigidly attached. For example, in one embodiment, the magnets 356 may be soldered to the side of the posts 340. In this example, the magnetic or ferromagnetic devices 356 attract flexible connectors 254 from portions of feed circuit 252 configured on adjacent columns 320 to form baluns.

In one embodiment, the connectors 354 are transmission line conductors. In one embodiment, transmission line conductors 354 may be formed of flexible conductors, such as copper traces, that releasably couple energy from the antenna feed circuit 252 to the antenna balun structure configured across adjacent columns 320. In some embodiments, the connectors 354 may include both flexible conductors and rigid contacts for electrical connection to portions of feed circuit 352 configured on adjacent columns 320.

Electrical coupling of flexible conductors to portion of feed circuit 352 on other columns may be provided using any suitable approach. In one embodiment, the magnetic or ferromagnetic devices 356 may provide an attractive force between adjacent connectors 354. For example, electrical interconnection may be accomplished by placing columns 320 adjacent to one another such that connectors 354 may be attracted using magnetic or ferromagnetic devices 356 to form an electrical connection to a portion of feed circuit 354 on another column 320. As a non-limiting example, the magnetic or ferromagnetic devices 356 may be incorporated using the method of U.S. application Ser. no. 12/489,015, entitled "Magnetic Interconnection Device," which is being filed concurrently.

In the example shown in FIGS. 4A, 4B, and 4C, the connectors 354 feature an upright portion 354*a* and an extension portion 354*b*. In this example, some of the upright portions 354*a* are fixed to a corresponding post 340. For example, these upright portions 354*a* may be soldered to the post 340. However, in this example, other upright portions 354*a* are not fixed to a corresponding post 340; rather, these upright portions 354*a* are freestanding. In this example, the freestanding upright portions 354*a* may be magnetically charged such that they are attracted to and connect with magnetic or ferromagnetic devices 356 on an adjacent column 320.

Figure 5A:
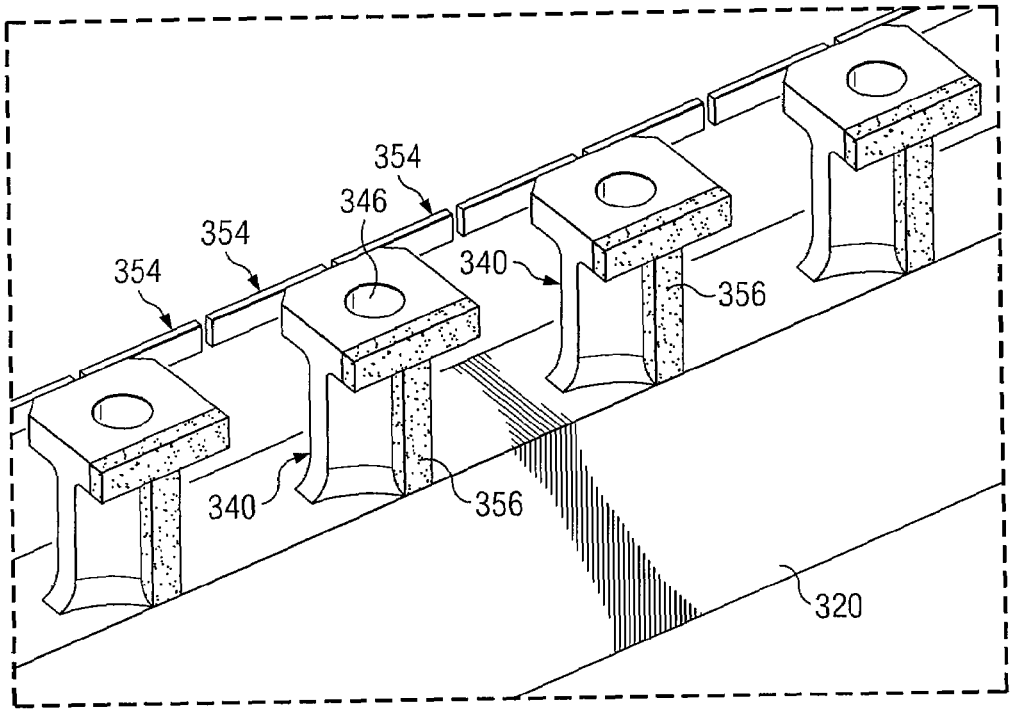
FIGS. 5A, 5B, and 5C show perspective views of a feed circuit implemented in a single-sided feed architecture according to another embodiment.
Figure 5B:
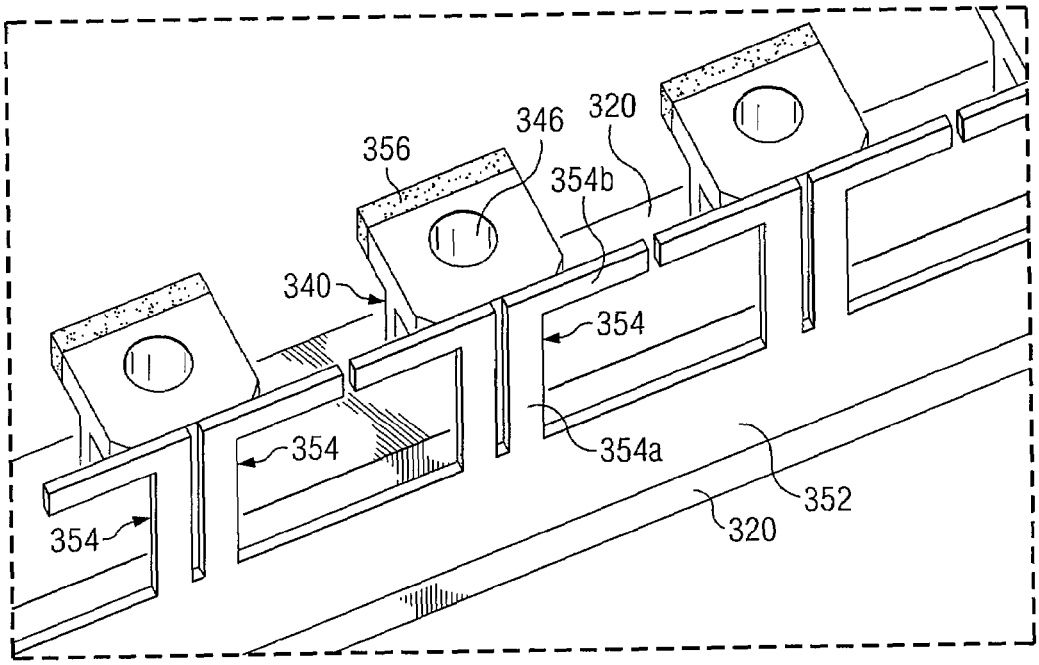
Figure 5C:
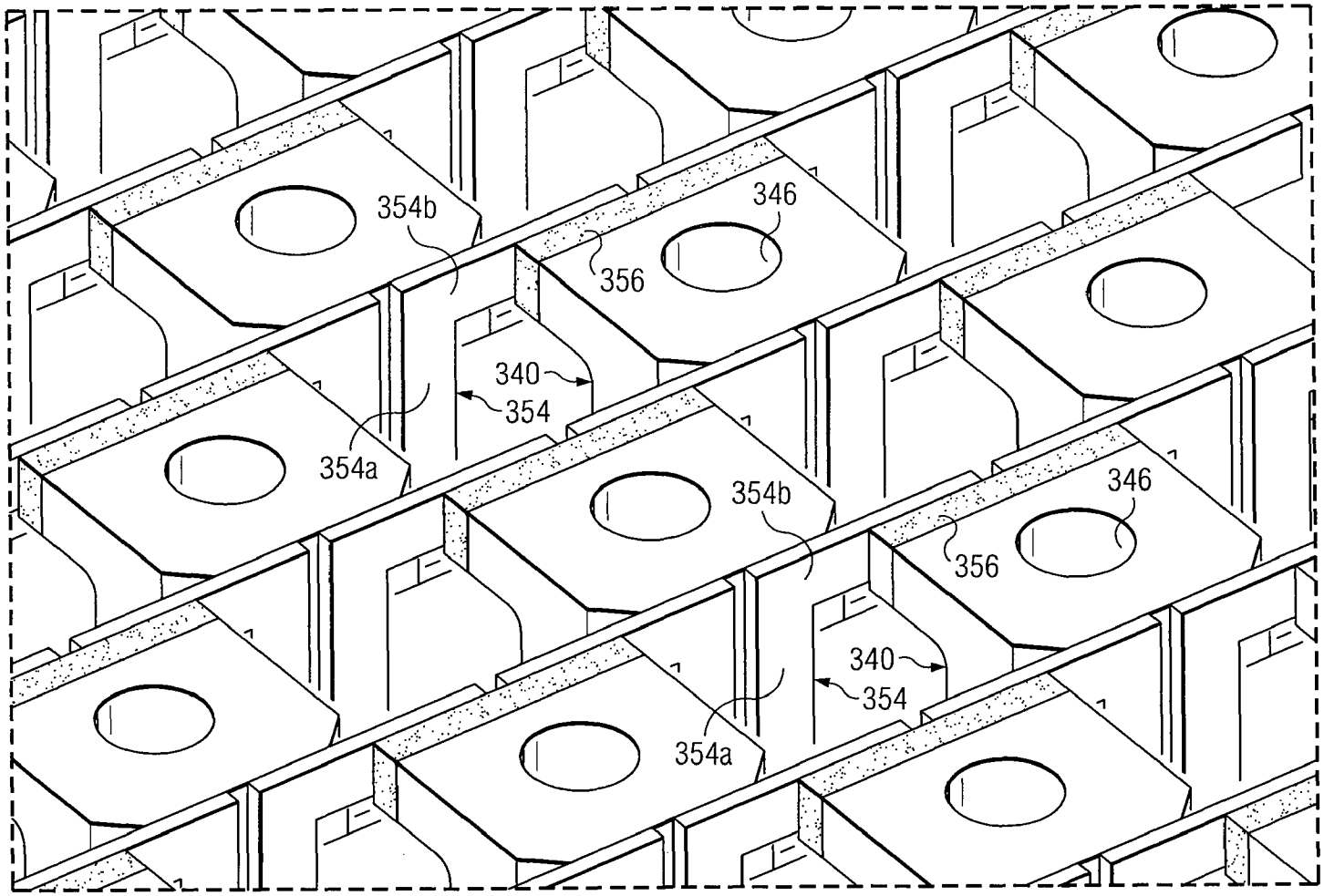

FIGS. 5A, 5B, and 5C show perspective views of feed circuit 352 implemented in a single-sided feed architecture according to another embodiment. In this embodiment, the connectors 354 of FIGS. 4A, 4B, and 4C are rearranged such that each upright portion 354*a* is fixed to a corresponding post 340. In this manner, two upright portions 354*a* may be fixed to each post 340. For each pair of upright portions 354*a* extending up a post 340, the corresponding extension portions 354*b* extend in opposite directions. In this example, the extension portions 354*b* are free to connect to the post 340 on a adjacent column 320. For example, the extension portions 354*b* may be magnetically charged such that it is attracted to and connects with a magnetic or ferromagnetic device 356 on an adjacent column 320.

Figure 6A:
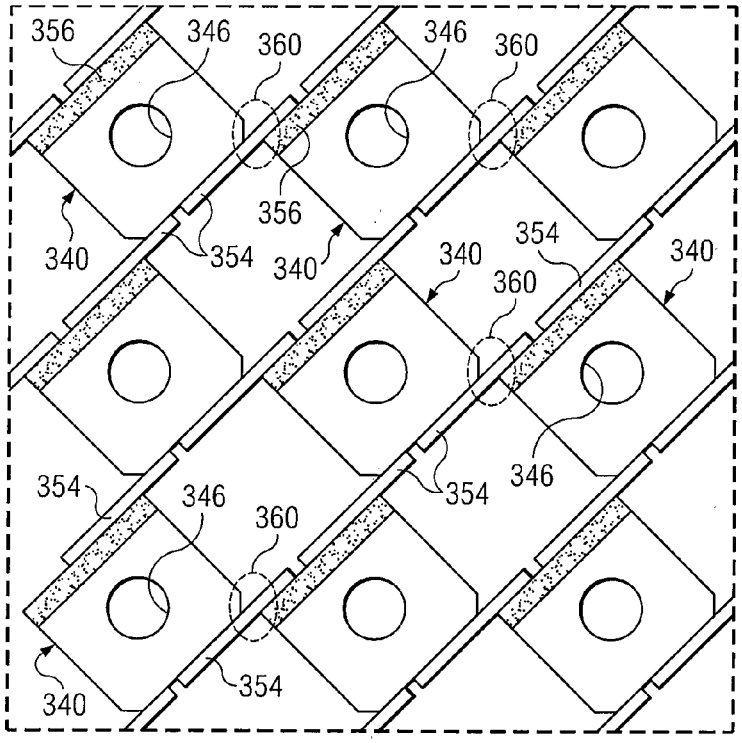
FIGS. 6A and 6B show plan views of an antenna array according to one embodiment.
Figure 6B:
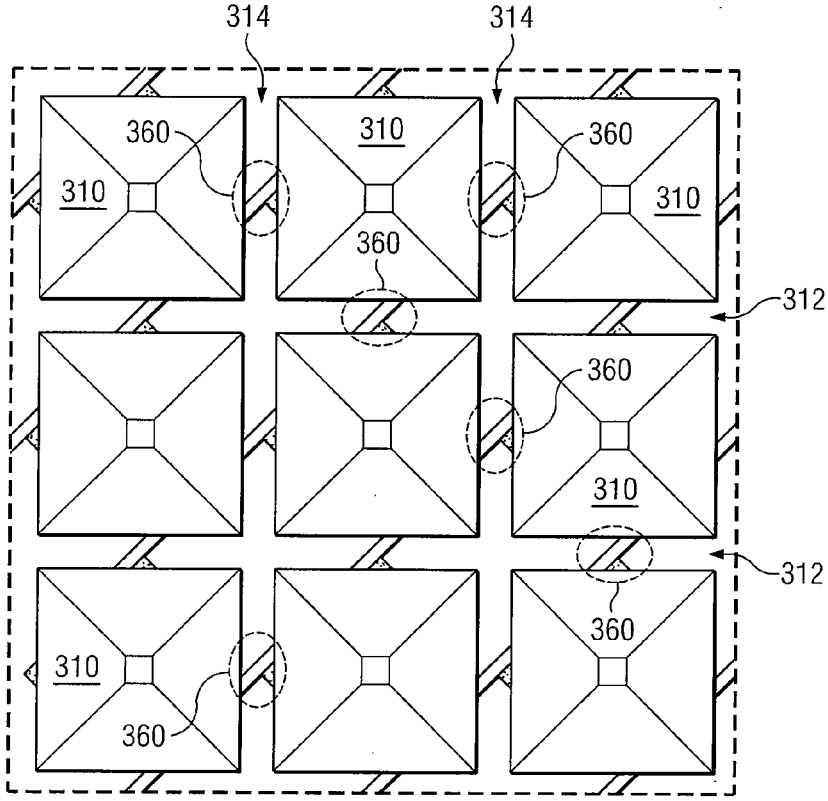

FIGS. 6A and 6B show plan views of an antenna array 300 according to one embodiment. This example plan view incorporates elements from the columns 320 of FIGS. 4A-4C. FIG. 6A shows a plan view of the antenna array 300 without tapers 310, and FIG. 6B shows a plan view of the antenna array 300 with tapers 310.

In this example, adjacent tapers 310 form first antenna elements 312 and second antenna elements 314. The connectors 354 and magnetic or ferromagnetic devices 356 connect at a connection 360. This connection 360 may form a balun between the bases of two adjacent tapers 310. This balun may provide balanced signals that to propagate through first antenna elements 312 and second antenna elements 314 as electro-magnetic energy.

Modifications, additions, or omissions may be made to the systems and apparatuses described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

Although the present invention has been described with several embodiments, a myriad of changes, variations, alterations, transformations, and modifications may be suggested to one skilled in the art, and it is intended that the present invention encompass such changes, variations, alterations, transformation, and modifications as they fall within the scope of the appended claims.

To aid the Patent Office, and any readers of any patent issued on this application in interpreting the claims appended hereto, applicants wish to note that they do not intend any of the appended claims to invoke 6 of 35 U.S.C. §112 as it exists on the date of filing hereof unless the words "means for" or "step for" are explicitly used in the particular claim.

What is claimed is:

1. An antenna array comprising:

an array base;

a plurality of antenna tapers protruding from the array base, each antenna taper having multiple sides forming a plurality of first antenna elements having a first polarity and a plurality of second antenna elements having a second polarity that is different from the first polarity;

a feed circuit coupling the plurality of first antenna elements and the plurality of second antenna elements to an electrical drive circuit, the feed circuit configured on a plurality of columns extending in a direction that is oblique to the plurality of first antenna elements and the plurality of second antenna elements; and a column alignment pin for each of the plurality of feed circuit columns configured to align a respective column to the array base.

2. The antenna array of claim 1, wherein the plurality of columns extend in a direction that is 45 degrees relative to the plurality of first antenna elements and the plurality of second antenna elements.

3. The antenna array of claim 1, further comprising a plurality of baluns, each of the plurality of baluns being proximate to one of the plurality of first and second antenna elements.

4. The antenna array of claim 1, wherein the feed circuit is configured on the plurality of columns using a single-sided feed circuit architecture.

5. The antenna array of claim 1, wherein the feed circuit is configured on the plurality of columns using a double-sided feed circuit architecture.

6. The antenna array of claim 1, further comprising a plurality of Transmit/Receive Integrated Microwave Module (TRIMM) cards, each of the TRIMM cards being secured to one of the plurality of columns, the TRIMM cards operable to attach to an array base.

7. The antenna array of claim 1, wherein the feed circuit couples to the plurality of first antenna elements and the plurality of second antenna elements through a magnetic interconnect.

8. The antenna array of claim 1, wherein the feed circuit comprises a plurality of stripline circuits.

9. The antenna array of claim 1, wherein the plurality of first antenna elements and the plurality of second antenna elements comprise a plurality of slotline radiators.

10. The antenna array of claim 9, wherein: the plurality of slotline radiators are formed from a plurality of conductive tapers having a square-shaped bottom edge, the square-shaped bottom edge coupled to the column.

11. The antenna array of claim 9, further comprising a plurality of balun posts, wherein: each of the plurality of balun posts secures to each of the plurality of conductive tapers at the square-shaped bottom edge; and the plurality of columns are arranged in a parallel, staggered formation such that a first balun post secured to a first column aligns with a first space on a second column, the first space representing a space between two adjacent balun posts on the second column.

12. The antenna array of claim 10, wherein: each of the plurality of balun posts has a first pair of sides oriented in the direction of the plurality of columns and a second pair of sides oriented in a direction orthogonal to the orientation of the first pair of sides, the first and second pairs of sides meeting at four edges of the balun post; and each of the plurality of balun posts has four surfaces cut into the four edges of the balun post, the four surfaces comprising a first pair of surfaces and a second pair of surfaces, the first pair of surfaces being oriented in the direction of the first polarity, the second pair of faces being oriented in the direction of the second polarity.

13. The antenna array of claim 12, wherein the feed circuit comprises a plurality of stripline circuits, the plurality of stripline circuits being secured to the plurality of balun posts.

14. The antenna array of claim 1, wherein the second polarity is orthogonal to the first polarity.

15. An antenna array column comprising: a support structure having a length extending in a first direction; a plurality of receptacles disposed within the support structure, each receptacle configured to: receive a conductive taper, the conductive taper is configured to set the direction of a polarity of an antenna element; and orient the antenna element in a direction that is oblique to the first direction; and a feed circuit secured to the support structure and operable to couple the antenna element to an electrical drive circuit, wherein the conductive taper is further configured to set the direction of a polarity of a second antenna element, the second polarity being different from the first polarity.

16. The antenna array column of claim 15, wherein the second polarity is orthogonal to the first polarity.

17. The antenna array column of claim 15, wherein the antenna element is oriented in a direction that is 45 degrees relative to the first direction.

18. The antenna array column of claim 15, further comprising a balun proximate to the antenna element.

19. The antenna array column of claim 15, wherein the feed circuit is configured on the support structure using a single-sided feed circuit architecture.

20. The antenna array column of claim 15, wherein the feed circuit is configured on the support structure using a double-sided feed circuit architecture.

21. The antenna array column of claim 15, further comprising a Transmit/Receive Integrated Microwave Module (TRIMM) card, the TRIMM card being secured to the support structure.

22. The antenna array column of claim 15, wherein the feed circuit couples to the antenna element to the electrical drive circuit through a magnetic interconnect.

23. The antenna array column of claim 15, wherein the feed circuit comprises a stripline circuit.

24. The antenna array column of claim 15, wherein the antenna element is a slotline radiator.

25. The antenna array column of claim 15, wherein the conductive taper has a square-shaped bottom edge, the receptacle further operable to receive the square-shaped bottom edge.

26. The antenna array column of claim 15, further comprising a plurality of balun posts, the plurality of balun posts being secured to the support structure, the plurality of receptacles being disposed within each of the plurality of balun posts.

27. The antenna array column of claim 26, wherein the plurality of balun posts are separated along the support structure by a space, the length of the space being approximate to the length of one side of the square-shaped bottom edge.

28. The antenna array column of claim 26, wherein the feed circuit comprises a plurality of stripline circuits, the plurality of stripline circuits being secured to the plurality of balun posts.

* * * * *